US009968133B2

(12) United States Patent
Li et al.

(10) Patent No.: US 9,968,133 B2
(45) Date of Patent: May 15, 2018

(54) ATOMIZER AND ELECTRONIC CIGARETTE HAVING SAME

(71) Applicant: Shenzhen First Union Technology Co., Ltd., Shenzhen, Guangdong (CN)

(72) Inventors: Yonghai Li, Shenzhen (CN); Zhongli Xu, Shenzhen (CN)

(73) Assignee: Shenzhen First Union Technology Co., Ltd., Shenzhen (CN)

( * ) Notice: Subject to any disclaimer, the term of this patent is extended or adjusted under 35 U.S.C. 154(b) by 778 days.

(21) Appl. No.: 14/315,346

(22) Filed: Jun. 26, 2014

(65) Prior Publication Data

US 2015/0007836 A1 Jan. 8, 2015

(30) Foreign Application Priority Data

Jul. 8, 2013 (CN) ..... 2013 1 0283289

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

2013/0213418 A1* 8/2013 Tucker ..... A24F 47/008
131/328

* cited by examiner

*Primary Examiner* — Paul S Hyun

(57) ABSTRACT

An exemplary atomizer includes an atomizing sleeve, a liquid chamber, a liquid stopper, a liquid filling opening, and an atomizing assembly. The liquid chamber is defined in the atomizing sleeve, and configured for storing tobacco liquid. The atomizing assembly is received in the liquid stopper, and capable of moving along an axial direction of the liquid stopper between a first position and a second position relative to the liquid stopper. When the atomizing assembly is in the first position, the liquid filling opening communicates with the liquid chamber, so that the tobacco liquid in the liquid chamber can flow to the atomizing assembly via the liquid filling opening. When the atomizing assembly is in the second position, the liquid filling opening is closed, so that no tobacco liquid in the liquid chamber can flow to the atomizing assembly via the liquid filling opening.

16 Claims, 6 Drawing Sheets

ATOMIZER AND ELECTRONIC CIGARETTE HAVING SAME

TECHNICAL FIELD

The present invention relates to electronic cigarettes, and particularly to an atomizer and an electronic cigarette using same.

BACKGROUND ART

Electronic cigarettes are similar to conventional cigarettes in appearance and taste, but less harmful to human's health. Accordingly, electronic cigarettes are widely used for helping people to quit smoking. Atomizers are key components of the electronic cigarettes. In a typical atomizer, tobacco liquid is stored in a liquid chamber, conveyed to a glass fiber core, and then vaporized by a heating wire. However, the tobacco liquid may leak from the atomizer during transportation and carrying, making the user experience unpleasant.

What is needed, therefore, is an atomizer and an electronic cigarette using same, which can overcome the above shortcomings.

SUMMARY

An exemplary atomizer includes an atomizing sleeve, a liquid chamber, a liquid stopper, a liquid filling opening, and an atomizing assembly. The liquid chamber is defined in the atomizing sleeve, and configured for storing tobacco liquid. The atomizing assembly is received in the liquid stopper, and capable of moving along an axial direction of the liquid stopper between a first position and a second position relative to the liquid stopper. When the atomizing assembly is in the first position, the liquid filling opening communicates with the liquid chamber, so that the tobacco liquid in the liquid chamber can flow to the atomizing assembly via the liquid filling opening. When the atomizing assembly is in the second position, the liquid filling opening is closed, so that no tobacco liquid in the liquid chamber can flow to the atomizing assembly via the liquid filling opening.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present atomizer and electronic cigarette. Moreover, in the drawings, like reference numerals designate corresponding parts throughout the several views.

DETAILED DESCRIPTION

Embodiments of the present disclosure will now be described in detail below and with references to the drawings.

Figure 1:
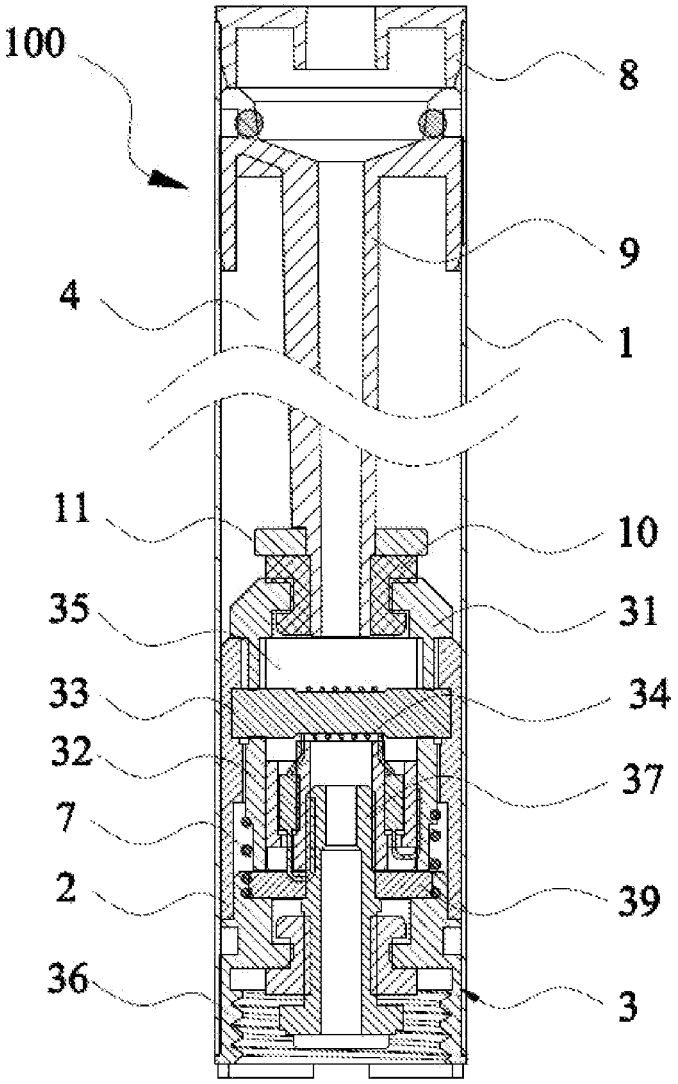
FIG. 1 is a cross-sectional view of an atomizer in a first state according to a first embodiment.
Figure 2:
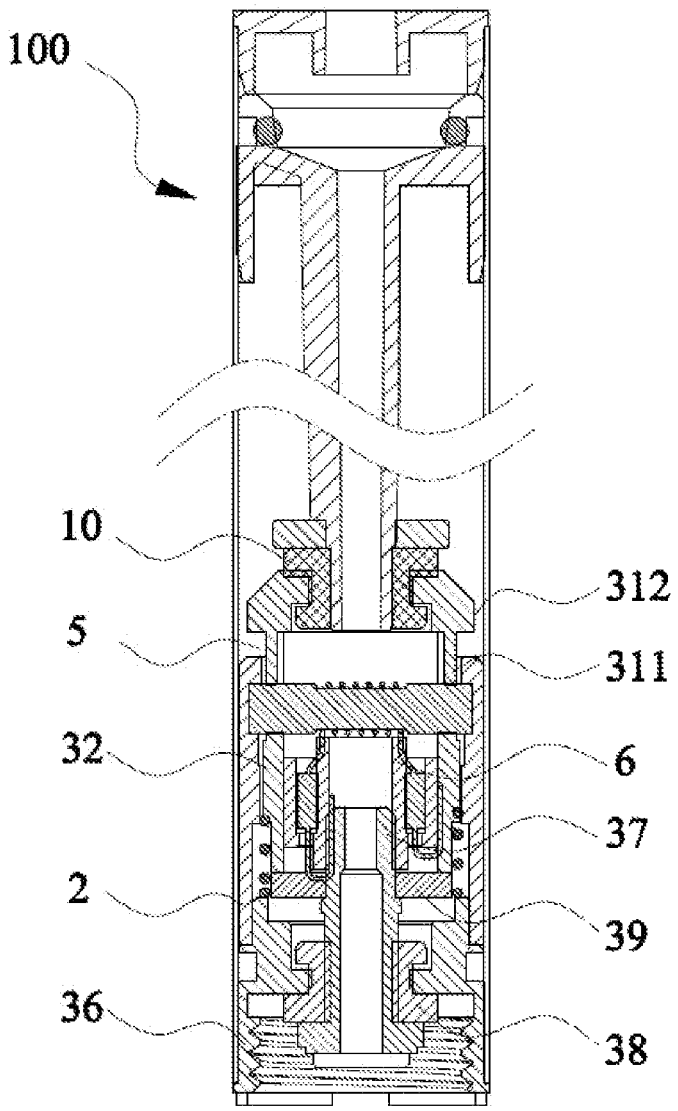
FIG. 2 is a cross-sectional view of the atomizer of FIG. 1 in a second state.
Figure 3:
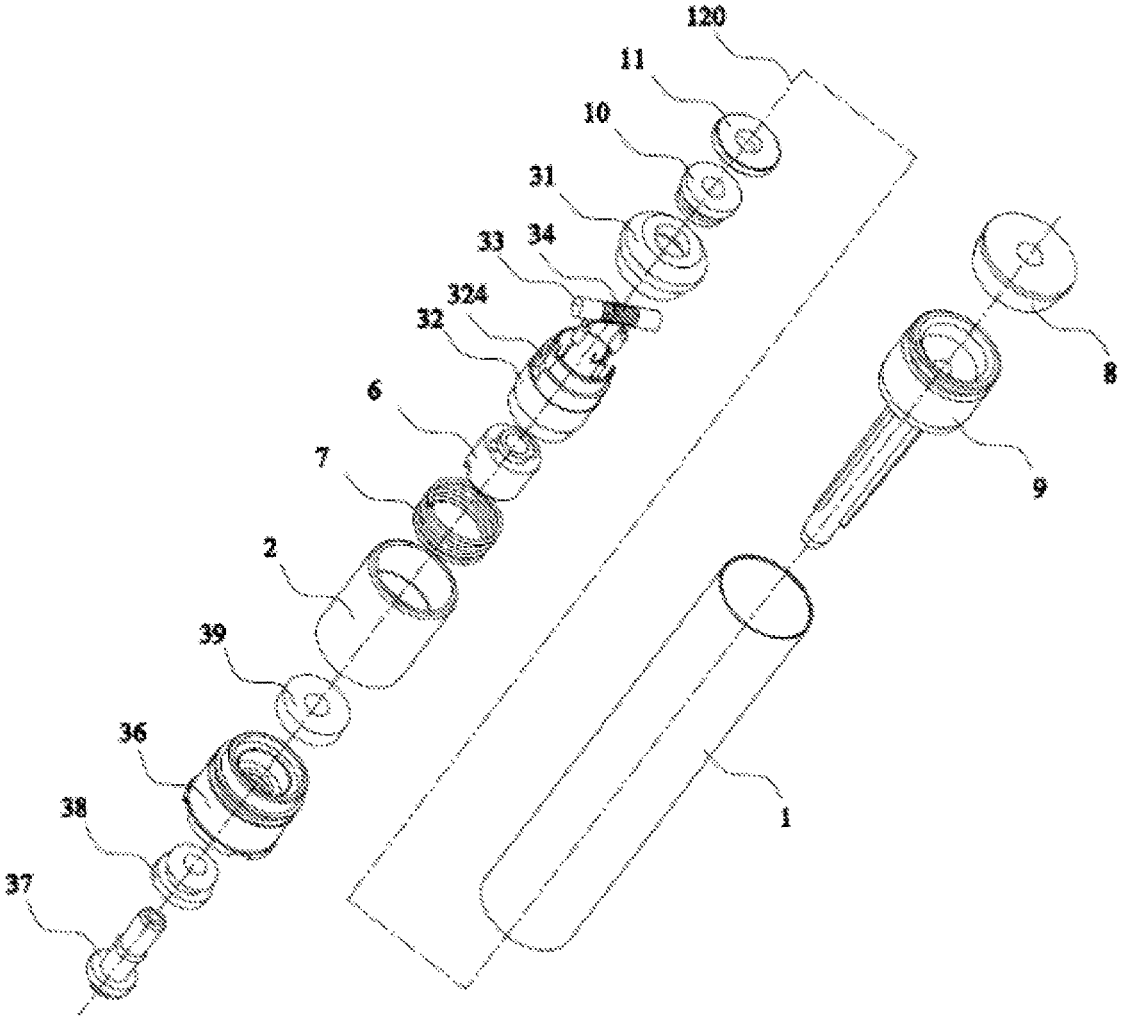
FIG. 3 is an exploded perspective view of the atomizer of FIG. 1.

Referring to FIGS. 1-3, an atomizer 100 includes an atomizing sleeve 1, a ring-shaped liquid stopper 2 fixed in the atomizing sleeve 1, and an atomizing assembly 3. The atomizing assembly 3 is disposed in the liquid stopper 2, and is capable of moving along an axial direction (i.e., along the central axis 120) of the liquid stopper 2. The atomizing sleeve 1 defines a liquid chamber 4 for storing tobacco liquid. In the present embodiment, the liquid chamber 4 does not have a cotton filled therein, i.e., the atomizer 100 is a cottonless atomizer. The atomizing assembly 3 can get the tobacco liquid through a liquid filling opening 5. When the atomizing assembly 3 moves up or down relative to the liquid stopper 2, the liquid filling opening 5 is opened or closed, thus allowing or disallowing the tobacco liquid to enter the atomizing assembly 3. The liquid filling opening 5 communicates with the liquid chamber 4. When the liquid filling opening 5 is opened, the tobacco liquid enters the atomizing assembly 3 directly, and is heated to form aerosol. The user sucks the aerosol, thus stimulating the effect of smoking.

Figure 4:
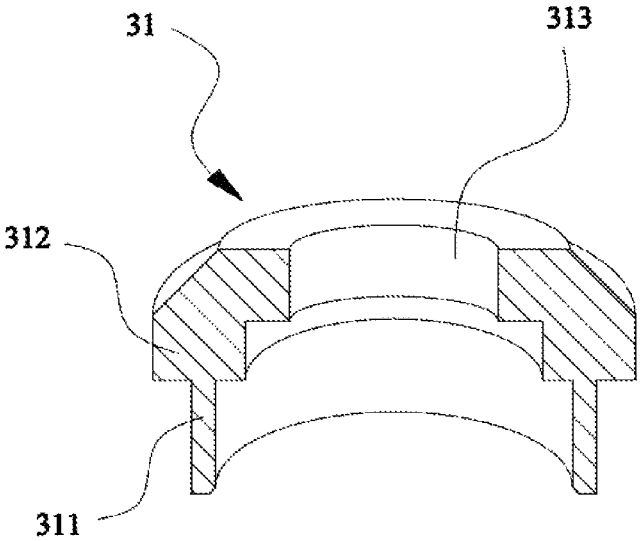
FIG. 4 is a perspective partially cut-away view of a liquid obstruction cover of the atomizer of FIG. 1.

Also referring to FIG. 4, the atomizing assembly 3 includes a liquid obstruction cover 31. The liquid obstruction cover 31 includes a wall 311 and a flange 312. The wall 311 is engaged with the liquid stopper 2 by clearance fit. The flange 312 extends from one end of the wall 311. The wall 311 and an inner wall of the liquid stopper 2 cooperatively form a gap, which communicates with the liquid filling opening 5. The flange 312 rests on an upper surface of the liquid stopper 2 tightly, thus sealing the liquid filling opening 5 and preventing the tobacco liquid from entering the atomizing assembly 3.

The atomizing assembly 3 further includes a partition sleeve 32, a glass fiber core 33, and a heating wire 34. The glass fiber core 33 is engaged in slots 324, which are defined in a sidewall of the partition sleeve 32. The heating wire 34 is wound around the glass fiber core 33, and configured (i.e., structured and arranged) for heating and atomizing the tobacco liquid on the glass fiber core 33. The liquid obstruction cover 31 nests on the top of the partition sleeve 32, and seals the top of the partition sleeve 32 to form an atomization cavity 35. At the same time, a length of the wall 311 is configured such that a bottom end of the liquid obstruction cover 31 contacts the glass fiber core 33, and the liquid obstruction cover 31 seals the slots 324 in the partition sleeve 32. To prevent the tobacco liquid from flowing into the atomization cavity 35 via the slots 324, an inner diameter of the liquid obstruction cover 31 is substantially equal to an outer diameter of the partition sleeve 32. In this way, when the liquid obstruction cover 31 nests on the top of the partition sleeve 32, the tobacco liquid is prevented from flowing into the atomization cavity 35 through the slots 324 and gap between the liquid obstruction cover 31 and the partition sleeve 32. Two ends of the glass fiber core 33 extend into gap between the liquid stopper 2 and the wall 311 to absorb the tobacco liquid, which flows in from the liquid filling opening 5.

Figure 5:
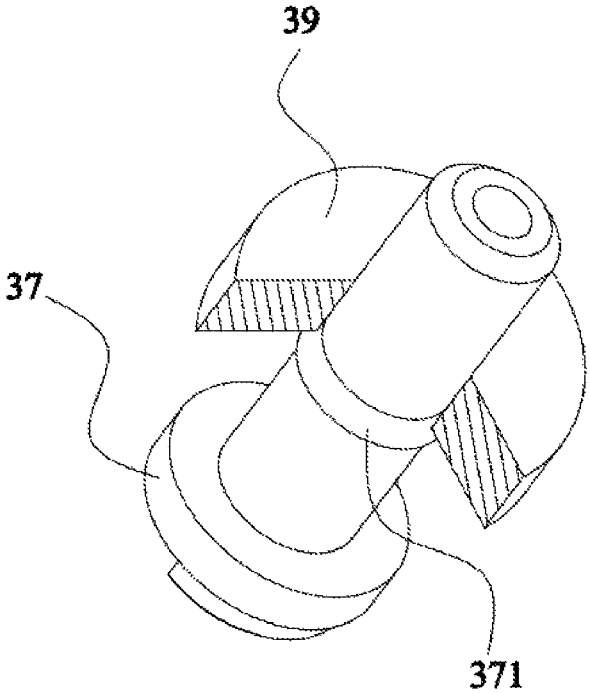
FIG. 5 is a perspective view showing a tubular electrode coupled with a support ring of the atomizer of FIG. 1.

Also referring to FIG. 5, the atomizing assembly 3 further includes a metallic sleeve 36 and a tubular electrode 37. The metallic sleeve 36 is fixed in the atomizing sleeve 1, and the tubular electrode 37 is received in the metallic sleeve 36. An insulation ring 38 is arranged between the tubular electrode 37 and the metallic sleeve 36, so that the tubular electrode 37 is insulated from the metallic sleeve 36.

A support ring 39 nest the tubular electrode 37, and the tubular electrode includes a support part 371 for positioning and supporting the support ring 39. In the present embodiment, the partition sleeve 32 rests on the support ring 39. The partition sleeve 32, the liquid obstruction cover 31, the glass fiber core 33 and the heating wire 34 can be lifted by pushing a bottom end of the tubular electrode 37, thus elevating the atomizing assembly 3. After the liquid obstruction cover 31 is lifted, the flange 311 of the liquid obstruction cover 31 is separated from the upper surface of the liquid stopper 2, the liquid filling opening 5 is opened, the tobacco liquid flows to gap between the liquid stopper 2 and the liquid obstruction cover 31, and then is conveyed to the glass fiber core 33. In this status, the atomizer 100 can be used.

Figure 6:
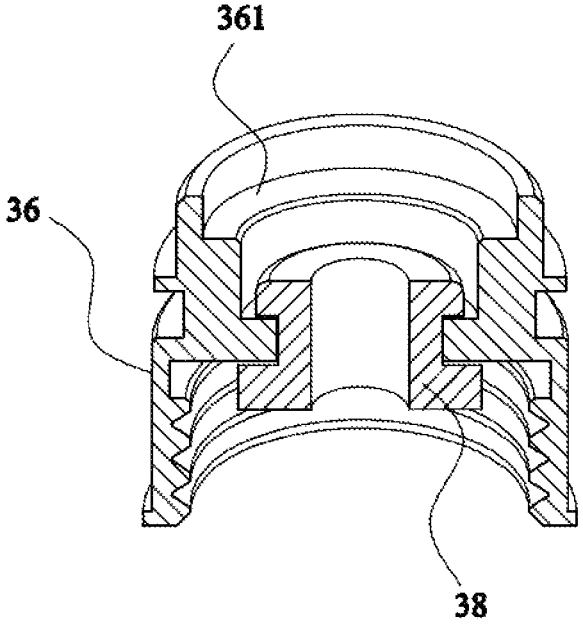
FIG. 6 is a perspective partially cut-away view showing a metallic sleeve engaged with an insulation ring of the atomizer of FIG. 1.

After the liquid obstruction cover 31 is moved downwards to such a position that the flange 311 of the liquid obstruction cover 31 rests on the upper surface of the liquid stopper 2, the liquid filling opening 5 is sealed, no tobacco liquid is conveyed to the glass fiber core 33. In this status, the atomizer 100 stops working, and the tobacco liquid in the liquid chamber 4 is prevented from leaking out of the atomizer 100. Referring to FIG. 6, the metallic sleeve 36 defines a counterbore 361. When the atomizing assembly 3 is moved downwards, the support ring 39 is received in the counterbore 361 with a bottom of the counterbore 361 supporting the support ring 39, thus positioning the atomizing assembly 3.

The atomizer 100 further includes a fixing sleeve 6 received in the partition sleeve 32. The fixing sleeve 6 is coaxial with the partition sleeve 32, and defines a hole 61. A top end of the tubular electrode 37 inserts the hole 61. Two ends of the heating wire 34 pass through the fixing sleeve 6, bend into the hole 61 and to outer surface of the fixing sleeve 6, respectively, and then electrically connect to the tubular electrode 37 and the partition sleeve 32.

The tubular electrode 37 and the partition sleeve 32 serve as two electrodes of the heating wire 34. The tubular electrode 37 and the partition sleeve 32 are made of conductive materials, e.g., metallic materials. In the present embodiment, the atomizer 100 is directly connected to a power supply via the tubular electrode 37 and the metallic sleeve 36. An electrical connector 7 is arranged between the partition sleeve 32 and the metallic sleeve 36, so that the partition sleeve 32 electrically connects to the metallic sleeve 36. The electrical connector 7 may be a metallic spring, and so on.

Referring to FIG. 1 again, the atomizer 100 further includes a mouthpiece cover 8 and an air pipe 9. The air pipe 9 is arranged between the mouthpiece cover 8 and the liquid obstruction cover 31, and is hermitically fixed in the atomizing sleeve 1. The air pipe 9, the atomizing sleeve 1, the liquid obstruction cover 31 and the liquid stopper 2 cooperatively form the liquid chamber 4. The liquid obstruction cover 31 defines a through hole 313, and a lower part of the air pipe 9 insert the through hole 313. An air passage is formed between the atomizing assembly 3 and the mouthpiece cover 8 so that aerosol from the atomization cavity 35 can reach mouth of the user via the air passage.

Because the atomizing assembly 3 is movable, and the air pipe 9 is fixed, an elastic element 10 is arranged between the liquid obstruction cover 31 and the air pipe 9 to ensure the hermetic engagement between the air pipe 9 and the liquid obstruction cover 31. The elastic element 10 is engaged in the through hole 313. The elastic element 10 may be made of silica gel.

The air pipe 9 includes a step portion. The atomizer 100 includes a restriction ring 11 fixedly sleeving the step portion, and the restriction ring 11 rests on the elastic element 10, preventing the elastic element 10 from passing the step portion and sliding along the air pipe 9. When the elastic element 10 is deformed, the elastic element 10 can provide the atomizing assembly 3 an elastic force to return to an original position (i.e., the flange 311 of the liquid obstruction cover 31 rests on the upper surface of the liquid stopper 2).

Figure 7:
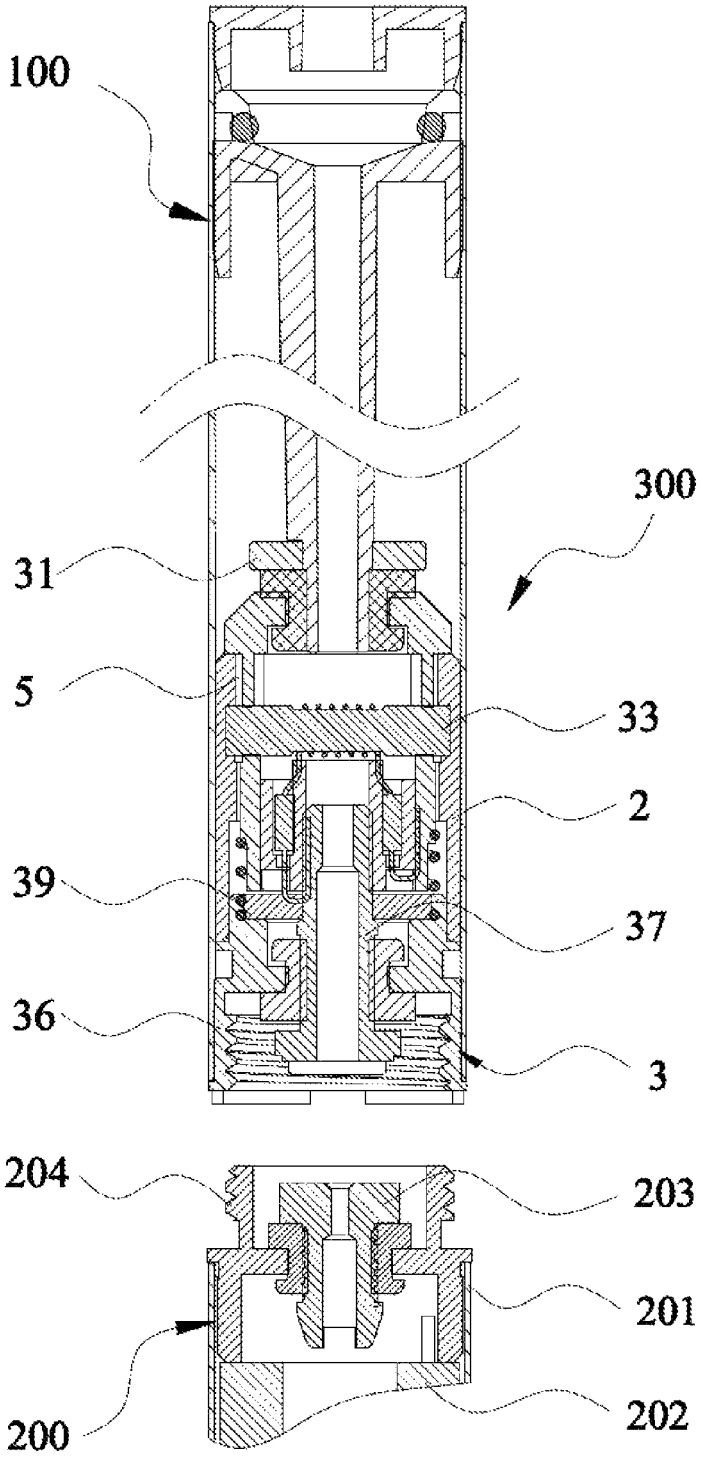
FIG. 7 is a cross-sectional view of an electronic cigarette.

Referring to FIG. 7, an electronic cigarette 300 is provided. The electronic cigarette 300 includes the atomizer 100 of the first embodiment and a battery stick 200 used as a power supply. The battery stick 200 includes a casing 201, a battery assembly 202 in the casing 201, and a central pin 203 at one end of the casing 201. The central pin 203 is electrically connected to the battery assembly 202. The casing 201 includes an outer screw 204 formed at the end thereof. The outer screw 204 is for engaging with the atomizer 100. After the casing 201 is threadedly coupled to the atomizer 100, the central pin 203 pushes an end of the tubular electrode 37, the tubular electrode 37 drives the atomizer assembly 3 to move axially relative to the liquid stopper 2, then the liquid filling opening 5 is opened. In this position, the tobacco liquid is conveyed to the glass fiber core 33, and the electronic cigarette 300 can be used.

After detaching the battery stick 200 from the atomizer 100, the atomizing assembly 3 is moved downwards upon the elastic force of the elastic element 10 until the support ring 39 rests on the metallic sleeve 36. In this position, the liquid filling opening 5 is sealed, no tobacco liquid is conveyed to the glass fiber core 33, thus eliminating or reducing the leakage of the tobacco liquid from the liquid chamber 4.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer comprising:

an atomizing sleeve;

a liquid chamber defined in the atomizing sleeve, and configured for storing tobacco liquid;

a ring-shaped liquid stopper received in the atomizing sleeve; and an atomizing assembly received in the liquid stopper, the atomizing assembly comprising a liquid obstruction cover, the liquid obstruction cover comprising a wall and a flange extending from one end of the wall;

wherein the wall is engaged with the liquid stopper by clearance fit so as to define a liquid filling opening between the wall and an inner surface of the liquid stopper;

wherein the atomizing assembly is movable along an axial direction of the liquid stopper between a first position where the liquid filling opening communicates with the liquid chamber, so that the tobacco liquid in the liquid chamber flows to the atomizing assembly via the liquid filling opening, and a second position where the liquid filling opening is closed, so that no tobacco liquid in the liquid chamber flows to the atomizing assembly via the liquid filling opening.

2. The atomizer of claim 1, wherein the flange is configured for resting on an upper surface of the liquid stopper, thus sealing the liquid filling opening.

3. The atomizer of claim 2, wherein the atomizing assembly further comprises a partition sleeve, a glass fiber core, and a heating wire wound around the glass fiber core, the glass fiber core is engaged in the partition sleeve, the liquid obstruction cover nests on top of partition sleeve, and two ends of the glass fiber core extend to a gap between the liquid stopper and the wall.

4. The atomizer of claim 3, wherein the atomizing assembly further comprises a metallic sleeve and a tubular electrode, the metallic sleeve is fixed in the atomizing sleeve; and the tubular electrode is received in the metallic sleeve and insulated from the metallic sleeve.

5. The atomizer of claim 4, wherein the tubular electrode comprises a support part, the atomizing assembly further comprises a support ring, the support ring is supported by a support part of the tubular electrode; and the partition sleeve rests on the support ring.

6. The atomizer of claim 5, further comprising a fixing sleeve received in the partition sleeve, wherein two ends of the heating wire pass through the fixing sleeve, then electrically connect to the tubular electrode and the partition sleeve respectively.

7. The atomizer of claim 6, wherein the partition sleeve is made of a metallic material.

8. The atomizer of claim 6, further comprising an electrical connector arranged between the partition sleeve and the metallic sleeve.

9. The atomizer of claim 1, further comprising a mouthpiece cover and an air pipe, wherein the air pipe is arranged between the mouthpiece cover and the liquid obstruction cover; the liquid obstruction cover defines a through hole, and one end of the air pipe inserts the through hole, thus forming an air passage between the atomizing assembly and the mouthpiece cover.

10. The atomizer of claim 9, further comprising a restriction ring and an elastic element, wherein the restriction ring is fixedly sleeved on the air pipe, and the elastic element is arranged between the restriction ring and the liquid obstruction cover.

11. An electronic cigarette comprising:

an atomizer, the atomizer comprising:

an atomizing sleeve;

a liquid chamber defined in the atomizing sleeve, and configured for storing tobacco liquid;

a liquid stopper received in the atomizing sleeve; and an atomizing assembly in the liquid stopper, the atomizing assembly comprising a liquid obstruction cover, the liquid obstruction cover comprising a wall and a flange extending from one end of the wall; and a power supply for powering the atomizer;

wherein the wall is engaged with the liquid stopper by clearance fit so as to define a liquid filling opening between the wall and an inner surface of the liquid stopper;

wherein the atomizing assembly is capable of moving along an axial direction of the liquid stopper between a first position and a second position, when the atomizing assembly is in the first position, the liquid filling opening communicates with the liquid chamber, so that the tobacco liquid in the liquid chamber flows to the atomizing assembly via the liquid filling opening; when the atomizing assembly is in the second position, the liquid filling opening is closed, so that no tobacco liquid in the liquid chamber flows to the atomizing assembly via the liquid filling opening.

12. The electronic cigarette of claim 11, wherein the flange is configured for resting on an upper surface of the liquid stopper, thus sealing the liquid filling opening.

13. The electronic cigarette of claim 12, wherein the atomizing assembly further comprises a partition sleeve, a glass fiber core, and a heating wire wound around the glass fiber core, the glass fiber core is engaged in the partition sleeve, the obstruction cover nests on top of partition sleeve, and two ends of the glass fiber core extend to a gap between the liquid stopper and the wall.

14. The electronic cigarette of claim 13, wherein the atomizing assembly further comprises a metallic sleeve and a tubular electrode, the metallic sleeve is fixed in the atomizing sleeve; and the tubular electrode is received in the metallic sleeve and insulated from the metallic sleeve.

15. The electronic cigarette of claim 14, wherein the tubular electrode comprises a support part, the atomizing assembly further comprises a support ring, the support ring is supported by a support part of the tubular electrode; and the partition sleeve rests on the support ring.

16. The electronic cigarette of claim 15, further comprising a fixing sleeve received in the partition sleeve, wherein two ends of the heating wire pass through the fixing sleeve, then are electrically connected to the tubular electrode and the partition sleeve respectively.

* * * * *